US007939751B2

(12) United States Patent
Asplund et al.

(10) Patent No.: US 7,939,751 B2
(45) Date of Patent: May 10, 2011

(54) LAND ELECTRODE

(75) Inventors: Gunnar Asplund, Ludvika (SE); Olof Heyman, Ludvika (SE); Urban Åström, Saxdalen (SE)

(73) Assignee: ABB Technology Ltd., Zürich (CH)

( * ) Notice: Subject to any disclaimer, the term of this patent is extended or adjusted under 35 U.S.C. 154(b) by 289 days.

(21) Appl. No.: 12/299,435

(22) PCT Filed: May 4, 2006

(86) PCT No.: PCT/SE2006/050100

§ 371 (c)(1),
(2), (4) Date: Nov. 3, 2008

(87) PCT Pub. No.: WO2007/129940

PCT Pub. Date: Nov. 15, 2007

(65) Prior Publication Data

US 2010/0230125 A1 Sep. 16, 2010

(51) Int. Cl.
*H01R 4/66* (2006.01)

(52) U.S. Cl. ..... 174/6; 174/7; 174/68.1; 174/135; 439/92; 204/280; 204/196.01

(58) Field of Classification Search ..... 174/6, 7, 174/68.1, 68.3, 70 R, 70 S, 101, 135; 204/196.01, 204/280; 439/92
See application file for complete search history.

(56) References Cited

U.S. PATENT DOCUMENTS

| | | | | |
|---|---|---|---|---|
| 4,761,216 | A * | 8/1988 | Cawlfield | 204/284 |
| 5,910,236 | A * | 6/1999 | Iossel et al. | 204/280 |
| 6,029,453 | A * | 2/2000 | Mendive | 60/641.2 |
| 6,245,989 | B1 | 6/2001 | Iossel et al. | |

FOREIGN PATENT DOCUMENTS

| | | |
|---|---|---|
| WO | WO-95/00984 A1 | 1/1995 |
| WO | WO-98/56073 A1 | 12/1998 |

OTHER PUBLICATIONS

PCT/ISA/210—International Search Report—Feb. 21, 2007.
PCT/IPEA/409—International Preliminary Report on Patentability—Mar. 11, 2008.
Villas et al., *Calculation of electric field and potential distributions into soil and air media for a ground electrode of a HVDC System*, IEEE Transactions on Power Delivery, vol. 18, No. 3, Jul. 2003.

* cited by examiner

*Primary Examiner* — Dhiru R Patel
(74) *Attorney, Agent, or Firm* — Venable LLP; Eric J. Franklin

(57) ABSTRACT

A return path between a first HVDC station and a second HVDC station. A first electrode is connected to the first station and a second electrode is connected to the second station. The return path includes a first part including a first low resistive zone through the crust of the earth in which the first electrode is embedded. A second part includes the earth mantle. A third part includes a second low resistive zone through the crust of the earth in which the second electrode is embedded.

4 Claims, 1 Drawing Sheet

LAND ELECTRODE

CROSS-REFERENCE TO RELATED APPLICATIONS

1. Technical Field

The present invention concerns ground connection between a first and second high voltage direct current (HVDC) station.

2. Background of the Invention

For HVDC systems it is always needed to have a circuit. This can be achieved in several different ways. A first way is a bipole arrangement. In this case the circuit normally comprises two fully insulated lines, one in each direction. In case of a failure of one line, it is important to be able to run the system in monopole mode. In such a case it is industrial practice to use earth return with earth electrodes in both ends. The earth electrode is also used when the bipole is run in an unbalanced way. Due to problems related to earth return there is normally a time restriction for how long earth return is allowed.

A second way of achieving a circuit is a monopole arrangement. In this case the circuit is fully insulated in one direction and on low potential for the return. In some cases, earth return has been accepted. Commonly the continuous earth return is replaced by line return on low potential.

Depending on the position an earth electrode may comprise a land electrode or a sea electrode. Commonly an earth return path comprises a land electrode at both stations and a current path comprising soil and/or water. A major goal for the electrodes is to achieve a sufficient low resistivity and achieve a sufficient large connection area between the electrodes and the soil. A land electrode thus commonly comprises a large number of sub-electrodes where each sub-electrode is fed from a separate sub-electrode feeder cable. Normally the electrodes are positioned in the earth not deeper than 80 m.

In order to find a suitable area for embedding the electrode it commonly known to start from one station and look for a suitable soil condition in a direction towards the other station. The underlying assumption is that the conductivity will increase the closer to each other the electrodes are positioned.

There are two different types of problems reported in connection with earth electrodes. The first is related to contact between electrode and the ground in the vicinity of the electrode. This is handled today by proper design measures of the electrode in combination with local measurements of the resistively in earth around the electrode. The second problem is related to currents leaving the earth and going up in transformers, pipes etc in between the two stations. In some cases the current goes up in transformers and goes in power lines for a certain distance. This gives saturation of the transformer and is considered a serious problem with earth return.

From U.S. Pat. No. 6,245,989 a land electrode for high voltage direct current transmission system is previously known. The object of the electrode is to improve the rate of dissolution of the feeding elements.

SUMMARY OF THE INVENTION

A primary object of the present invention is to seek ways to improve the conductivity of an earth return path between a first and second HVDC station.

This object is achieved according to the invention by a return path including a first and second land electrode or by a method.

According to the invention a return path between a first and a second HVDC station comprises a first part containing a low resistive zone through the crust of the earth in the vicinity of the first HVDC station, a second part comprising the mantle of the earth, and a third part containing a second low resistive zone through the crust of the earth in the vicinity of the second HVDC station. A low resistive zone comprises a fracture or other equivalent geological structures in the crust of the earth.

The invention makes use of geological and geophysical methods to characterize the earth crust and mantle with respect to resistivity. By using such methods areas suitable for electrode placement are identified. These areas are characterized by the possibility for the current to go vertical down the 50 km to reach high conductive volumes of the earth.

The earth mantle is electrically conductive and is overlain by a crust. The crust comprises oceanic (ca 10 km) and continental (30-50 km) layers, and is divided into different continental plates. The oldest cores of continental crust can be found around the world. Electrically highly resistive rocks are abundant in these areas. Brittle fractures can be found in crystalline rock. The length of the fracture can be supposed to relate to its depth extent. Hence a 50 km long fracture zone might extend to the mantle. Such zones are usually water-bearing and low-resistive.

Different techniques are used to locate electrically conductive structures in the bedrock.

Electromagnetic

DC resistivity

Magnetometry, gravity . . . (indirectly)

The methods have different detail resolution, depth of investigation and survey costs.

One technique is based on electromagnetic measurements, of electric resistivity distribution along a vertical profile extending all the way to the mantle. A second technique is based on gravity measurements over the same area. The two methods are complementary and together they improve the geological interpretation.

A further technique is airborne measurements. By airborne electromagnetic measurements large areas are covered. The depth of these investigations is around 50 to 100 meters. Airborne magnetic measurements also cover large areas and give valuable information about geological structures.

Ground magnetic measurements give detailed information and may be compared with airborne magnetic measurements. Water-bearing fractures show up as low magnetic measurement values. Detailed DC resistivity measurements may reveal fractures as being a 50 to 80 meters wide and comprising 10 to 50 times more conductive than the host rock.

BRIEF DESCRIPTION OF THE DRAWINGS

Other features and advantages of the present invention will become more apparent to a person skilled in the art from the following detailed description in conjunction with the appended drawings in which.

DESCRIPTION OF PREFERRED EMBODIMENTS

Figure 1:
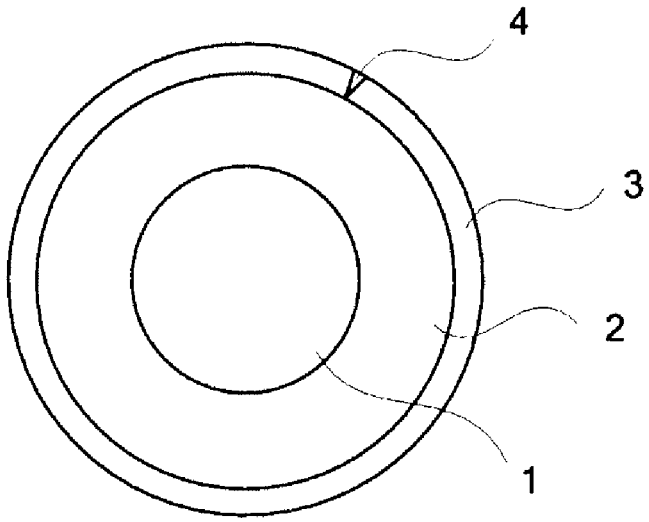
FIG. 1 is a principal sketch of the earth.

A section through earth is shown in FIG. 1. The earth consists of a core 1 and outside of that a mantle 2. On top of the mantle the earth consists of a crust 3. The crust comprises the continental plates and comprises preferably bedrock. On varies locations in the crust there are low resistive zones, which penetrates the crust. These low resistive zones comprise brittle fractures or geological deformations especially in crystalline rock. These fractures might extend down to the mantle. Since such zones are usually water-bearing and low-resistive they are ideal locations for land electrodes.

Figure 2:
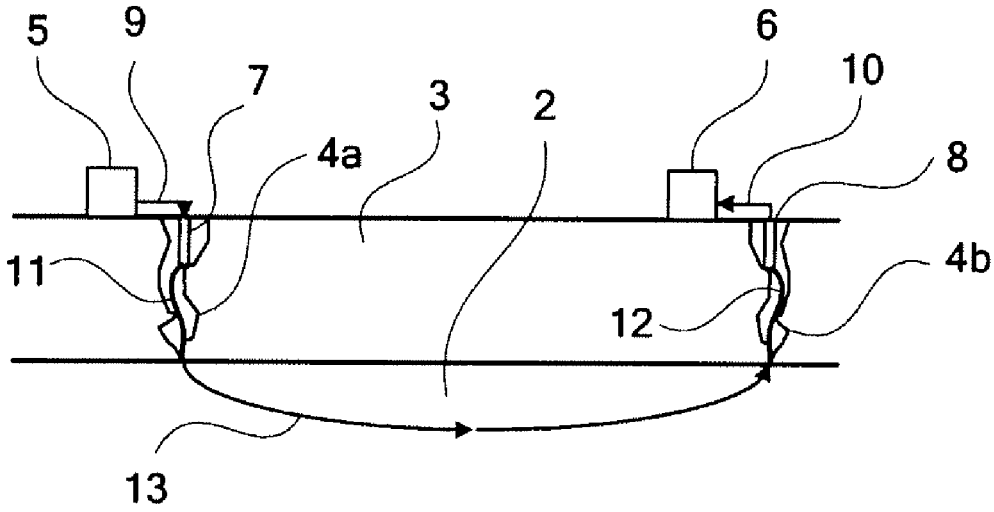
FIG. 2 is a section through the crust and mantle of the earth with a return path according to the invention.

An HVDC transmission system is shown in FIG. 2. The system comprises a first HVDC station 5 and a second HVDC station 6. The stations are resting on the crust 3 of the earth, which is about 50 km thick and resting on the mantle 2 of the earth. The mantle comprises very low resistivity. By using at least one geological method a first low resistive zone 4*a* in the crust is localized in the vicinity of the first HVDC station. Using the same geological methods a second low resistive zone 4*b* in the crust is localized in the vicinity of the second HVDC station. A first electrode 7 is localized in the first low resistive zone and a second electrode 8 is localized in the second low resistive zone. Hence, a return path between the first HVDC station and the second HVDC station is formed by a first current path 11 comprising a connection conductor 9, the first electrode 7 and the first low resistive zone 4*a*, a second path 13 comprising the mantle 2, and a third path 12 comprising the second low resistive zone 4*b*, the second electrode 8 and a second connection conductor 10.

The invention also includes a method for forming a return path between a first HVDC station (5) and a second HVDC station (6) including a first electrode (7) connected to the first station and a second electrode (8) connected to the second station. One embodiment of the method includes localizing a first low resistive zone (4*a*) through a crust (3) of the earth in the vicinity of the first HVDC station (5). The first electrode (7) may be embedded in the first resistive zone. A second low resistive zone (4*b*) may be localized through the crust (3) of the earth in the vicinity of the second HVDC station (6). The second electrode (8) may be embedded in the second resistive zone, whereby the return path is formed of the first low resistive zone, a mantle of the earth (2), and the second low resistive zone.

Although favorable the scope of the invention must not be limited by the embodiments presented but contain also embodiments obvious to a person skilled in the art. The location of the low resistive zone must not be localized between the two stations but rather in the vicinity around the station. Hence the most suitable return path may comprise low resistive zones in the crust which zones are situated in the vicinity of the first station but in any direction from the direction to the second station.

The invention claimed is:

1. A high voltage direct current system, comprising:

a return path between a first high voltage direct current station and a second high voltage direct current station, wherein the return path comprises a first electrode connected to the first station and a second electrode connected to the second station, wherein the return path comprises a first part comprising a first low resistive zone through a crust of the earth in which the first electrode is embedded, a second part comprising a mantle of the earth, and a third part comprising a second low resistive zone through the crust of the earth in which the second electrode is embedded.

2. The high voltage direct current system according to claim 1, wherein the low resistive zone comprises a brittle fracture in the crust.

3. A method for forming a return path between a first high voltage direct current station and a second high voltage direct current station comprising a first electrode connected to the first station and a second electrode connected to the second station, the method comprising:

localizing a first low resistive zone through a crust of the earth in the vicinity of the first high voltage direct current station, embedding the first electrode in the first resistive zone, localizing a second low resistive zone through the crust of the earth in the vicinity of the second high voltage direct current station, and embedding the second electrode in the second resistive zone, whereby the return path is formed of the first low resistive zone, a mantle of the earth, and the second low resistive zone.

4. The method according to claim 3, wherein the localizing comprises a geological method or a geophysical method.

* * * * *